US005427355A

United States Patent [19]

Sukonthapanich

[11] Patent Number: 5,427,355

[45] Date of Patent: Jun. 27, 1995

[54] LOAD REST RING FOR JACK

[75] Inventor: Dusit Sukonthapanich, Newmarket, Canada

[73] Assignee: Ventra Group Inc., Canada

[21] Appl. No.: 246,088

[22] Filed: May 19, 1994

[51] Int. Cl.[6] ..... B66F 3/36

[52] U.S. Cl. ..... 254/100

[58] Field of Search ..... 254/100, 101, 93 H, 254/133 R, DIG. 4; 403/377, 376, 397, DIG. 7; 81/177.85, 124.6

[56] References Cited

U.S. PATENT DOCUMENTS 1,572,770 2/1926 Colley ..... 403/DIG. 7
1,593,217 7/1926 Lucker .
1,600,058 9/1926 Morrison .
2,508,240 5/1950 Fenn ..... 254/133 R
4,752,708 12/1987 Taguchi ..... 403/DIG. 7
5,085,406 2/1992 Schmaltz .

FOREIGN PATENT DOCUMENTS 417156 8/1925 Germany ..... 403/DIG. 7

*Primary Examiner*—Robert C. Watson
*Attorney, Agent, or Firm*—Cushman, Darby & Cushman

[57] ABSTRACT

The invention is a load rest fastener for a screw jack comprising a broken wavy ribbon ring which may be inserted into a groove in the exterior surface of a column and a groove in the interior surface of a load rest flange.

7 Claims, 4 Drawing Sheets

LOAD REST RING FOR JACK

BACKGROUND

This invention relates to an improvement in mounting a load rest on a screw jack.

A general description of a screw jack will suffice to create a setting in which to describe this invention. A conventional screw jack comprises a supporting base, a housing mounted on the base, a gear mechanism within the housing, a load bearing column mounted in the housing to be driven vertically by the gear mechanism, and a drive pinion mounted in the side of the housing to permit a user to drive the gear mechanism to control the height of the load bearing column.

The load bearing column of a screw jack is usually topped with a load rest 1chat can rotate relative to the column to permit convenient positioning of grooves or other locating features on the load rest with respect to surface features of the load. The rotatable load rest assists in maintaining such positioning during lifting or lowering of the column and relative movement of the load. Examples of some load rests of prior art constructions may be found in U.S. Pat. Nos. 1,593,217, 1,600,058 and 5,085,406.

A known type of load rest, to which this invention is directed, has a cap-like structure with a flange that circumferentially surrounds a top portion of the column. The interior of the flange is grooved to receive a fastening mechanism. The column is also adapted to connect to a fastening mechanism. For example, it is known to have dimples spaced about the upper portion of the column which align to the flange groove of the load rest. Ball bearings are inserted into a hole in the flange of the load rest in communication with the flange groove. The load rest is turned to position each successive ball bearing in a dimple until all dimples are filled. When the last ball is placed in a dimple the hole in the flange is plugged. The depth of the dimples is less than the diameter of the ball bearings so that each ball protrudes into the flange groove. The ball bearings then prevent removal of the load rest by interacting with both the groove and dimples.

In another more relevant variation, the column is grooved about its top to align with the load rest flange groove, on assembly. In this configuration it is known to connect the parts with a broken spring wire ring. A ring is compressed in the groove of the column and covered with a sleeve. The load rest is then assembled onto the column to push the sleeve down as it slides over the column groove. When the grooves align the ring springs open into the groove of the load rest. The groove into which the ring is first assembled must have a sufficient depth to completely bury the ring as the load rest is assembled over the column. The other groove will have a depth less than the diameter of the wire to ensure that the ring protrudes from it into the first groove after assembly. Thus the ring fastens tile parts together.

In the competitive environment of manufacture of jacks, particularly vehicle jacks, emphasis is placed on low price, low weight and ease of assembly while maintaining or improving functionality. The ball bearings method described above complicates and slows the assembly procedure, resulting in increased costs of manufacture. The ring method is easy to assemble but the column groove must bury the ring completely during assembly to permit the flange to slip over the column.

Column wall thicknesses must accommodate a groove and provide sufficient strength for anticipated loads. The greater wall thickness to bury the; ring increases the weight and material cost of the jack.

It is an object of this invention to provide an improved load rest and column combination that simplifies the construction and reduces the cost of such means while retaining required strength and flexibility. In particular the improvement is directed to the provision of a novel binding ring to permit less intrusive grooves in the column and the load rest. It will be appreciated that this improvement is primarily intended for vehicle jacks but may find application in other screw jacks intended for other end uses.

DISCLOSURE OF THE INVENTION

In a screw jack including a moveable load bearing column with a circumferential column groove formed in an outside surface of a top portion of said column and including a load rest with a flange depending about a top portion of said column with a circumferential flange groove formed in an inside surface of said flange, the improvement comprising:

a ribbon to be assembled into said column and flange grooves, said ribbon having a first end, a second end, a width sized to rotate within said flange; and column grooves, a length formed with a plurality of waveform shapes, said ribbon curved to form a broken ring and biased to spring into a position to span both the column and flange grooves as the column groove aligns with the flange groove during assembly to fasten the load rest to the column and said ribbon having a stiffness across its width suitable to maintain its shape under the stresses expected in normal operation.

The ribbon of this invention may be fabricated from any suitable material depending on jack design and expected forces. It should be sufficiently resilient in bending and yet stiff across its width for the purposes described in this specification. In a preferred embodiment the material will permit the waveforms to be flattened and to spring back. Suitable materials will be obvious to one skilled in the art and will include spring steel.

The waveform shapes of the ribbon undulate along its length. Thus, points laterally positioned on its width will rise and fall together, preferably but not necessarily, to form a repeating waveform shape. The waveform may be of any suitable shape, for example, sinusoidal or square. The waveforms will fit within the depth of one of the grooves and in a preferred embodiment will fit within a groove when flattened.

The ribbon is curved over its length into an approximately round ring wherein its width is parallel to an axis of the ring and the waves undulate in and out in radial directions. The ring is broken between the first and second ends of the ribbon. The ends will approach one another in a compressed form of the ring and are spaced apart in an expanded form of the ring. The space between the ends may also allow for whatever extension of length is expected when the waveforms are flattened.

A load rest may be assembled to a column with the ribbon ring by fitting the ribbon ring of this invention into the flange groove or, alternatively, into a column groove and capping the column with the load rest. In the former case, the ribbon ring is biased to expand when released into the flange groove. In the latter case, it is expanded over the column and biased to compress, on release, into the column groove. While the ribbon ring is held in place, the waveforms are sufficiently flattened, reducing the waveform amplitude, to allow the ribbon to be buried in the original groove. The load rest is placed over the column until the column groove aligns to the flange groove, whereupon the ring is released to span into the groove, and the waveforms spring back to their original amplitude. The original groove will have a depth sufficient to bury the partially or completely flattened waveform. The receiving groove will have a depth more shallow than the depth of the waveforms to ensure that part of the waveforms of the ring remain in the original groove after release.

The advantage of the present invention is that the flat ribbon with its waveforms provides fastening strength while requiring a shallow groove, particularly when the waveforms are completely flattened. The lateral edges of the ribbon bent into waveforms catch in the grooves. The material of the ring is concentrated over its width to provide efficient fastening strength and structure. The waveform shape contributes to such strength and structure and provides an ability to span grooves and to accommodate tolerances. These features, in combination, assist a designer to obtain a minimal groove depth. Round wire, on the other hand, has no lateral edge but only a curved surface to catch the edge of the grooves. Tolerances of cuts and formed structures are more significant. Wire material is distributed across the wire cross-section to provide both spanning and strength without specialization.

IN THE FIGURES

In the Figures which illustrate the prior art and a preferred embodiment of this invention, FIG. 1 is an illustration of a prior art load rest assembled to a column using ball bearings.

DESCRIPTION OF PRIOR ART AND PREFERRED EMBODIMENT

Figure 1:
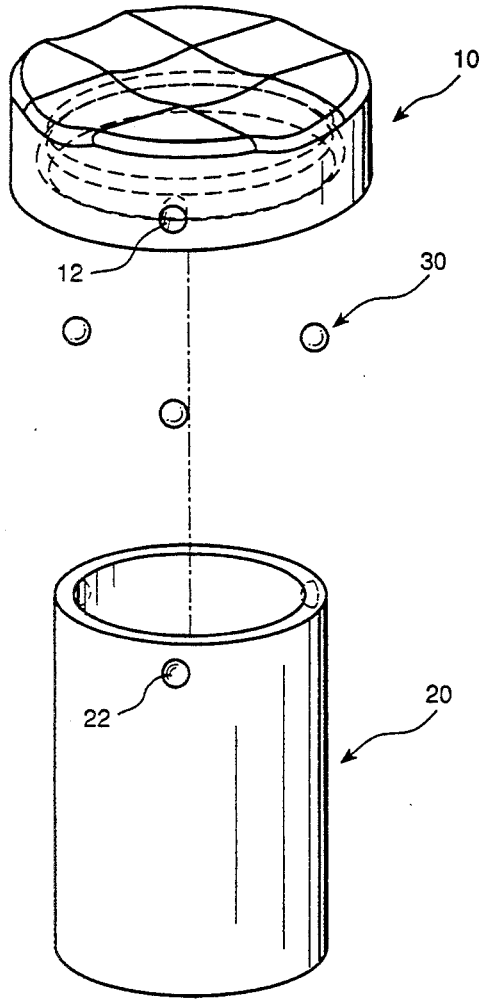
Fig. 1 (PRIOR ART)

FIG. 1 shows a known method of assembling a load rest (10) to a column tube (20) with ball bearings (30). The steel balls (30) are fitted through a hole (12) to reside in dimples (22) of the column (20). The load rest (10) is rotated as each ball is inserted to direct it into a dimple (22). After all three balls are positioned, the hole (12) is plugged.

Figure 2:
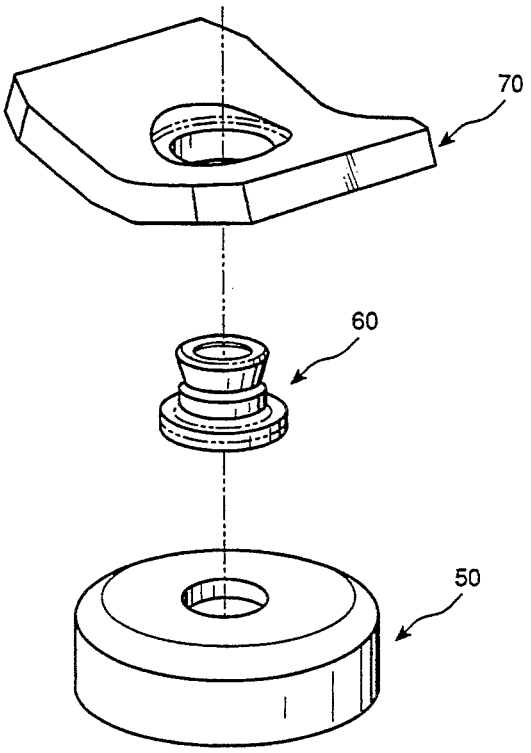
Fig. 2 (PRIOR ART)
FIG. 2 is an illustration of a prior art load rest affixed to a column having a rivet with a load-rest saddle.

FIG. 2 illustrates another prior art method. A rivet (60) attaches a saddle (70) to a load rest (50). The saddle (70) rotates about the rivet (60)with respect to the load rest (50). The load rest is fixed to a column.

Figure 3:
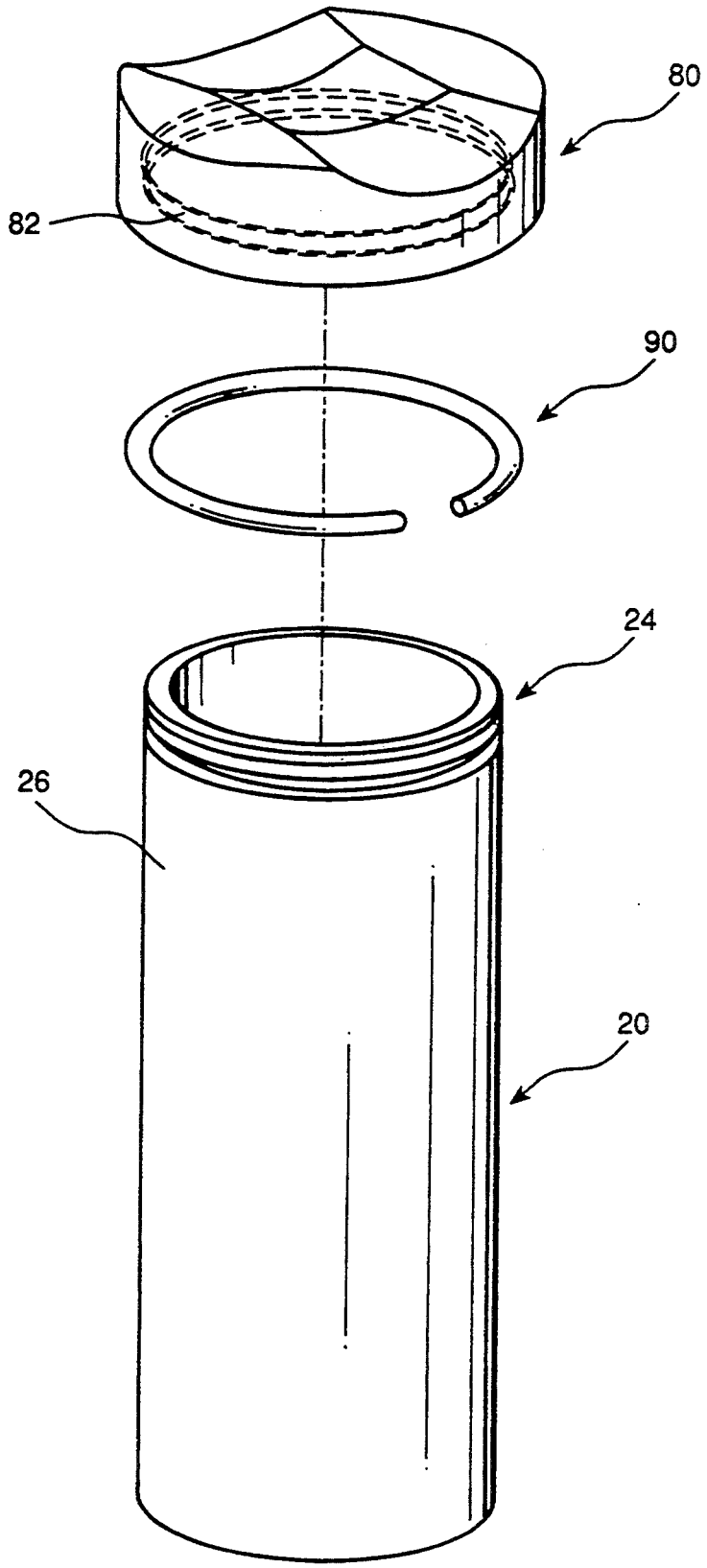
Fig. 3 (PRIOR ART)
FIG. 3 is an illustration of a prior art load rest having a flange groove and a broken wire spring connector.

FIG. 3 illustrates a known load rest and column combination similar to the combination used in the present invention. It comprises a load rest (80) having a round wire spring (90) to be mounted on a column (20). The column (20) has a column groove (24) in its outside surface (26). The load rest (80) has a flange groove (82) in its interior surface. Upon assembly, the spring wire (90) is compressed into the column groove (24) and the load rest (80) is slid over the column (20) until the wire spring (90) expands into the flange groove (82) to lock the parts together.

Figure 4:
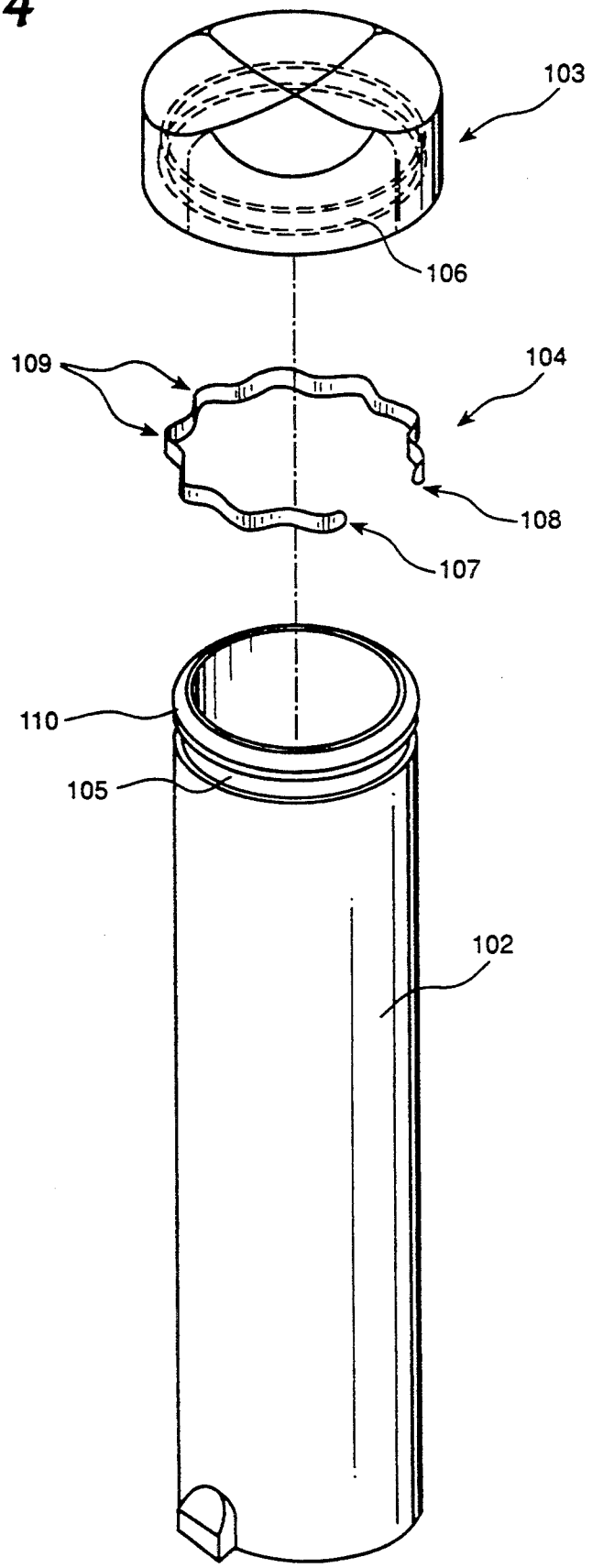
FIG. 4 is an exploded view of a column having a load rest connector in the preferred embodiment of the present invention.
Figure 5:
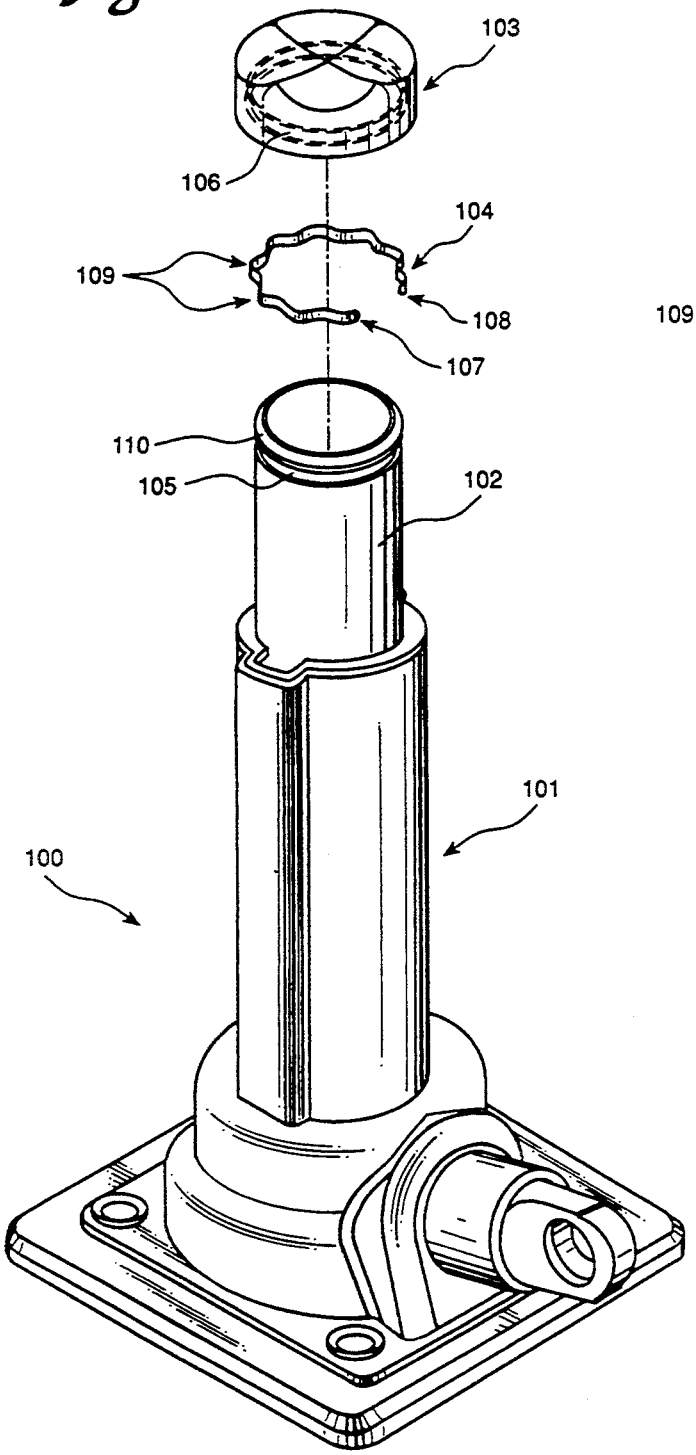
FIG. 5 is a detail of the preferred embodiment of the present invention.

FIGS. 4 and 5 illustrate the combination of the present invention. As shown in FIG. 5, a screw jack (100) has a housing (101), a column (102), a load rest (103) and a ribbon ring (104). The column (102) has a column groove (105)in its outside surface. The load rest (103) has a flange groove (106) in its interior surface. The ribbon ring (104) has a first end (107) and a second end (108). The ribbon is bent along its length in a plurality of waveforms (109) and is further curved along its length to form a broken ring. The ribbon ring (104) is broken between ends (107) and (108).

Figure 6:
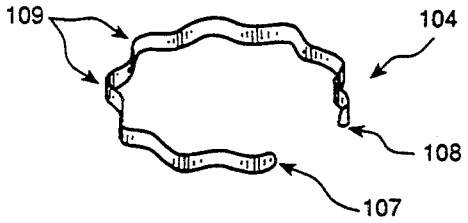
FIG. 6 is a detail of a the ring having waveforms.
Figure 7:
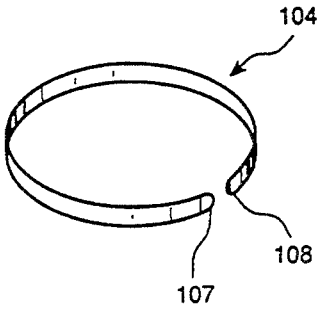
FIG. 7 is a detail of a ring having flattened waveforms.

In a preferred embodiment, the ring (104)is compressed into the column groove (105) and the waveforms (109) are flattened. See FIGS. 6 and 7 for an illustration of the ring (104) before and after the waveforms are flattened. As shown in FIG. 7, the ring ends (107 and 108) are sufficiently spaced apart to avoid overlapping in the flattened state.

The load rest (103) is slid over the column (102) until the column groove (105) is in alignment with the flange groove (106), whereupon the ring (104) expands into flange groove (106) while the waveforms (109) reform to span between the flange groove (106) and the column groove (105). The column groove (105) depth is sufficient only to accommodate the thickness of the flattened ribbon ring (104).

In another preferred embodiment the ribbon ring (104) is first placed in the flange groove (106) for assembly onto the column (102). In this embodiment a chamfer (110) is provided on the column (102) to assist in expanding and flattening the ring (104) during assembly.

It may be appreciated that the grooves may be formed as channels with flat sides to present gripping edges for the ribbon ring.

This invention permits the column groove (105) to be cut to a minimal depth and, therefore, permits fabrication of a column (102) with a thin wall thickness. The reduction of this wall thickness while retaining strength permits a competitive advantage in the manufacture of jacks.

The description has been intended to disclose this invention to a person skilled in the art of constructing screw jacks. The description is illustrative rather than limiting for other equivalent embodiments using the principle of this invention will be apparent to one skilled in the art. All such equivalents within the scope of this invention that have utility are claimed.

I claim:

1. In a screw jack including a moveable load bearing column having a top portion with an outside perimeter column groove and including a load rest having a flange depending about said top portion of the column with an inside perimeter flange groove, the improvement comprising:

a broken ribbon ring to connect the load rest on the column, said ribbon ring having a first end, a second end, a width sized to fit within said flange and column grooves and a length formed with a plurality of waveform shapes and curved in a ring shape;

said broken ribbon ring being expandable into the flange groove to clear the column while the load rest is assembled onto the column and being biased so that said waveforms span between aligned column and flange grooves; and said ribbon ring being sufficiently stiff across its width suitable to maintain its shape under the stresses expected in normal operation to fasten the load rest to the column, said column having a chamfer about a top thereof to help retain the ribbon ring in the flange groove and flatten the waveforms during assembly.

2. In a screw jack including a moveable load bearing column having a top portion with an outside perimeter column groove and including a load rest having a flange depending about said top portion of the column with an inside perimeter flange groove, the improvement comprising:

a broken ribbon ring to connect the load rest on the column, said ribbon ring having a first end, a second end, a width sized to fit within said flange and column grooves and a length formed with a plurality of waveform shapes and curved in a ring shape;

said broken ribbon ring being compressible into the column groove to clear the load rest flange while the load rest is assembled onto the column and being biased so that said waveforms span between aligned column and flange grooves;

said ribbon ring having a sufficient stiffness across its width to maintain its shape under the stresses expected in normal operation to fasten the load rest to the column, said flange having a chamfer about its inside bottom edge to help retain the ribbon ring in the column groove and flatten the waveforms during assembly.

3. The screw jack of claim 1 in which at least one of said column groove and said flange groove is a channel having flat sides.

4. The screw jack of claim 1 in which the flange groove has a depth sufficient to bury the waveforms of the ribbon ring in a partially or completely flattened shape during assembly until the flange groove aligns with the column groove and the ring is released, and the column groove is sufficiently deep to allow a first portion of the waveforms to enter the column groove in a fastening interference fit while sufficiently shallow to retain a second portion of the waveforms in the flange groove.

5. The screw jack of claim 2 in which the column groove has a depth sufficient to bury the waveforms of the ribbon ring in a partially or completely flattened shape during assembly until the flange groove aligns with the column groove and the ring is released, and the flange groove is sufficiently deep to allow a first portion of the waveforms to enter the flange groove in a fastening interference fit while sufficiently shallow to retain a second portion of the waveforms in the column groove.

6. The screw jack of claim 2 in which at least one of said column groove and said flange groove is a channel having flat sides.

7. In a screw jack including a moveable load bearing column having a top portion with an outside perimeter column groove and including a load rest having a flange depending about said top portion of the column with an inside perimeter flange groove, the improvement comprising:

a broken ribbon ring to connect the load rest on the column, said ribbon ring having a first end, a second end, a width sized to fit within said flange and column grooves and a length formed with a plurality of waveform shapes and curved in a ring shape;

said broken ribbon ring being distortable so as to be fully received into the groove of one of said flange and said column to clear the other of said flange and said column while the load rest is assembled onto the column and being biased so that said waveforms span between aligned column and flange grooves; and said ribbon ring being sufficiently stiff across its width suitable to maintain its shape under the stresses expected in normal operation to fasten the load rest to the column, the other of said flange and said column having a chamfer defined about an end thereof to help retain the ribbon ring in the said groove and flatten the waveforms during assembly.

* * * * *